United States Patent [19]

Pettersson

[11] Patent Number: 4,516,297

[45] Date of Patent: May 14, 1985

[54] CLOTH FASTENER

[76] Inventor: Klas A. Pettersson, Läggestavägen 16, S-124 31 Bandhagen, Sweden

[21] Appl. No.: 516,605

[22] PCT Filed: Nov. 26, 1982

[86] PCT No.: PCT/SE82/00405

§ 371 Date: Jul. 1, 1983

§ 102(e) Date: Jul. 1, 1983

[87] PCT Pub. No.: WO83/01889

PCT Pub. Date: Jun. 9, 1983

[30] Foreign Application Priority Data

Nov. 30, 1981 [SE] Sweden ..... 8107133

[51] Int. Cl.[3] ..... A44B 21/00

[52] U.S. Cl. ..... 24/498; 24/329; 24/496; 24/536

[58] Field of Search ..... 24/498, 496, 493, 494, 24/495, 492, 519, 460, 461, 462, 329, 330, 489, 536, 562, 680, 346, 72.5

[56] References Cited

U.S. PATENT DOCUMENTS

| | | | |
|---|---|---|---|
| 1,068,270 | 7/1913 | Posner | 24/519 |
| 1,772,395 | 8/1930 | Iseman | 24/498 |
| 2,483,303 | 9/1949 | Rysick | 24/496 |
| 2,867,027 | 1/1959 | Guyot | 24/519 |
| 2,988,314 | 6/1961 | Urich | 24/329 |
| 3,060,536 | 10/1962 | La Voie | 24/346 |
| 3,070,651 | 12/1962 | Semple et al. | 24/330 |
| 3,924,303 | 12/1975 | Elliott | 24/536 |
| 3,950,829 | 4/1976 | Cohen | 24/536 |

*Primary Examiner*—Victor N. Sakran

*Attorney, Agent, or Firm*—Sughrue, Mion, Zinn, Macpeak and Seas

[57] ABSTRACT

A fastener means for fastening a first piece of cloth to a fixed support or to a second piece of cloth. The fastener means comprises a first fastener member attached to the first piece of cloth (1) and comprising an outer and inner part (3, 5) which are arranged to clamp the first piece of cloth therebetween to be attached to the fixed support or to the second piece of cloth and to coact with the first fastener member. Each of the fastener members is provided with an opening (11, 12) and/or an outwardly projecting portion (13, 14), such as to enable the fastener members to be locked together with a snap-in action between the outwardly projecting portion and opening or openings respectively. The outer part (3) of the first fastener member includes a gripping portion (16) which serves as a lever arm and which when pressed in a direction towards the second fastener member, is arranged to release the engagement between the fastener members, as a result of a pivoting movements about a common abutment line between the fastener members. In a preferred embodimentintended for use when joining two cloth pieces (1 2) together, the second fastener member is identical to the first fastener member.

6 Claims, 8 Drawing Figures

CLOTH FASTENER

BACKGROUND OF THE INVENTION

The present invention relates to a fastener means for fastening a first piece of cloth to a fixed support or backing or to a second piece of cloth. The fastener means is of a kind which comprises a first fastener member having an inner and an outer part and arranged to be attached to a first piece of cloth with the cloth clamped between a inner and outer parts, and a second fastener member attached to a fixed support or backing or to a second piece of cloth and arranged to co-act with the first fastener member. Each of the first and second fastener members has an opening and/or an outwardly projecting portion provided with a hook means, and the two fastener members can be snapped together in locking fashion by inserting the hook means into a corresponding opening and pivoting in a first sense the first fastener member relative to the second fastener member. It will be understood that the word "cloth" as used here and in the following includes all manner of fabrics, coverings and like materials.

In present day sailing craft, for example, the boom is protected by means of a boom cover or sleeve which is often held together by a zip-fastener or heavy-duty press studs. Press studs are also used to fasten and secure boom tents and other forms of boat covers. Zip-fasteners are relatively expensive, and their use can present difficulties, for example when the boom cover must be stretched in order to bring it around the boom and furled sail. The most serious drawbacks associated with the use of press studs are that they require the use of both hands when unfastening a boom cover for example, and that it is necessary to gather in the actual cover in order to manipulate the studs, which can place the cover material under great strain and increase the risk of damage when fastening the studs. Furthermore, there is nothing to prevent a conventional press stud from unfastening when the cover is unintentionally pulled or tugged.

SUMMARY OF THE INVENTION

Consequently, the prime object of the invention is to provide a fastener means of the kind described in the introduction with which, among other things, the aforesaid drawbacks are eliminated.

This object is realized by means of the invention, in that each of the fastener members attached to the cloth is provided with a lever arm which enables the fastener to be released without requiring the cloth to be pulled.

The fastener means according to the invention is characterized in that the outer part of the first fastener member comprises a gripping portion which serves as a lever arm and which is arranged, when pressed towards the second fastener member, to cause a pivot movement of the outer part in a second sense opposite the above mentioned first sense about a common abutment line lying between the fastener members to release the engagement between them, and that the hook means are arranged to prohibit a releasing pivot movement in the first sense.

When the fastener means according to the invention is intended to fasten together two pieces of cloth, as hereinbefore defined, for example a boom cover, the second fastener member is preferably identical to the first fastener member, and each of the outer parts of the members includes a gripping portion which serves as a lever arm, the gripping portions being arranged so as to enable them to be pressed toward one another, to disengage the two fastener members one from the other. In this case, the inner parts of each of the fastener members is provided with an opening and with an outwardly projecting part, the outwardly projecting part of one fastener member being arranged to be snapped into the opening of the second fastener member in locking fashion, while the corresponding outwardly projecting part of the second fastener member snaps into the opening in the first fastener member. When fastening together two flexible pieces of cloth, this fastener design will enable the fasteners to be released with the use of only one hand, without requiring the cloth to be gathered in or drawn.

Another advantage afforded by a fastener means of such design is that only two items need be manufactured and stored, since the two fastener members are mutually identical and each comprise only two parts.

In order to prevent unintentional release of the fastener means, the outwardly projecting part, which preferably has the form of a slotted cylinder, is suitably provided with a shoulder portion which is arranged to co-act with a shoulder portion on the inner part of the opposing fastener member in a manner which, inter alia, prevents the fastener from being released when the cloth is pulled or tugged. In accordance with one preferred embodiment, the outwardly projecting part of one fastener member is arranged, when two fastener members are engaged, to co-act with locking tongues on the inner part of the second fastener member to prevent it from being loosened from the cloth.

BRIEF DESCRIPTION OF THE DRAWINGS

The invention will now be described in more detail with reference to the accompanying drawings.

DETAILED DESCRIPTION OF THE PREFERRED EMBODIMENTS

Figure 1:
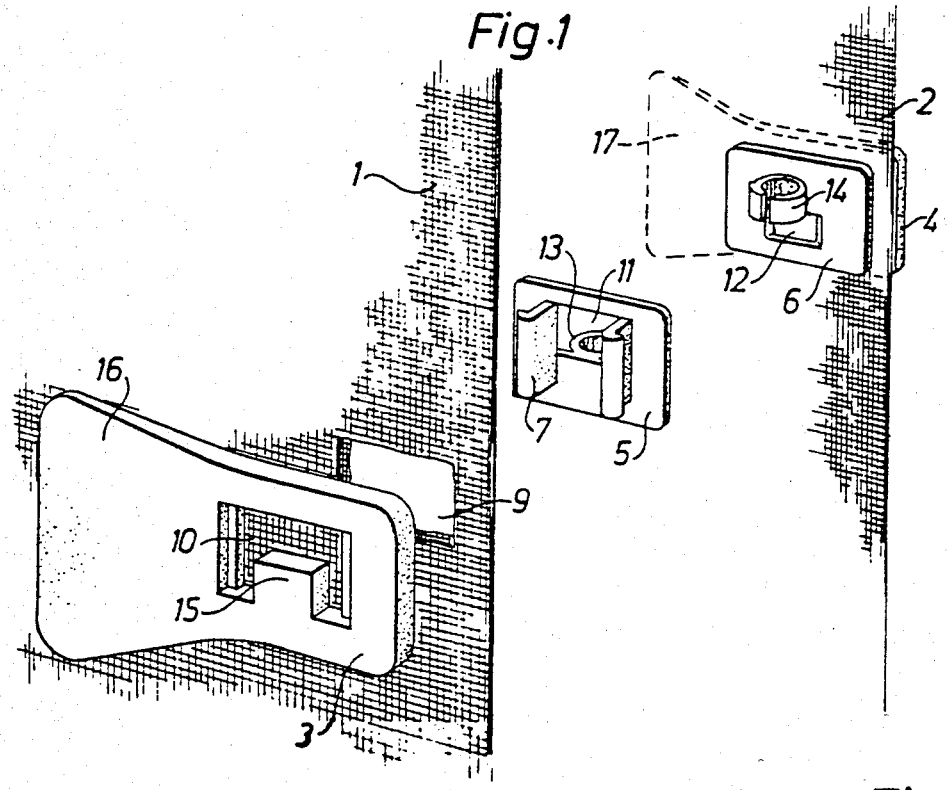
FIG. 1 is a partially exploded view of a fastener means according to the invention when used to fasten two pieces of cloth together.

The fastener means illustrated in FIG. 1 includes two identical fastener members which are attached to those parts 1 and 2 respectively of the pieces of cloth to be fastened together. Each fastener member comprises two parts, an outer flat part 3 and 4 respectively, and an inner locking plate 5 and 6 respectively. The locking plates 5 and 6 are provided with resilient locking tongues 7 and 8 respectively, which, for the purpose of attaching respective fastener members to their pieces of cloth, are intended to be passed through an opening 9 in said cloth and into an opening 10 in corresponding outer plates 3 and 4 respectively. To ensure positive anchorage of the cloth, the flat outer parts 3 and 4 and the inner locking plates 5 and 6 may be provided with grooves and corresponding ridges arranged to co-act with one another to firmly snap lock said cloth pieces.

Figure 2:
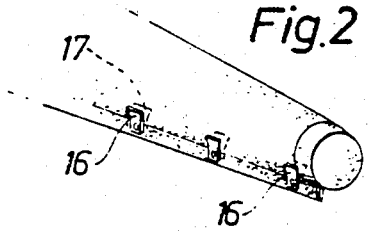
FIG. 2 illustrates the fastener means shown in FIG. 1 when used to fasten a boom cover.

To enable the two fastener members to be locked together, the locking plates 5 and 6 are each provided with an opening 11 and 12 respectively, and a projection 13 and 14 located adjacent said opening. The projections 13 and 14 have the form of slotted cylinders so dimensioned that they are able to snap into the opening in an opposing locking plate under a given degree of deformation. This is possible despite the fact that each fastener member comprises identical locking plates and outer, flat parts, because when mounting the fastener means illustrated in FIGS. 1 and 2 the one fastener member is upside down in relation to the other fastener members; FIG. 2 shows the use of fastener means according to FIG. 1 when fastening a boom cover.

The use of identical fastener members makes the manufacture and the mounting of said fastener means more simple and less expensive. Furthermore, fastening is effected with a double snap-in engagement, which provides a positive locking action.

The openings 10 in the outer, flat parts 3 and 4 respectively are provided with fillers 15, to prevent relative movement between two mutually engaging fastener members. Each of the parts 3 and 4 are provided with a respective gripping portion 16, 17 serving as a lever arm, these gripping portions being arranged to release the mutual engagement of the fastener members when said gripping portions are pressed towards one another, in a manner more clearly described hereinafter.

Figure 3:
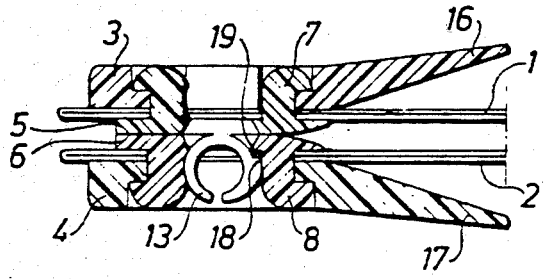
FIGS. 3 and 4 are sectional views of the fastener means illustrated in FIG. 1, in a locked and released position respectively.

FIG. 3 is a sectional view of the two fastener members in engagement with one another. In this position of the fastener members, the projection 13 of the locking plate 5 has been pressed into the opening 12 of the locking plate 6 and in a corresponding manner, although not seen from the sectional view, the projection 14 of the locking plate 6 has been pressed into the opening 11 of the locking plate 5. As will be seen from the Figure, the projection 13 is provided with a shoulder portion 18 arranged to engage a shoulder portion 19 on the locking plate 6 to prevent the disengagement of the two fastener members should the pieces of cloth 1 and 2 be pulled or tugged or should the lever arm 16 and 17 be moved apart. Further, when the cylindrical projections 13, 14 co-act with the locking tongues 8 and 7, respectively, the fastener members are prevented from releasing from respective parts 1, 2 of the cloth material.

Figure 4:
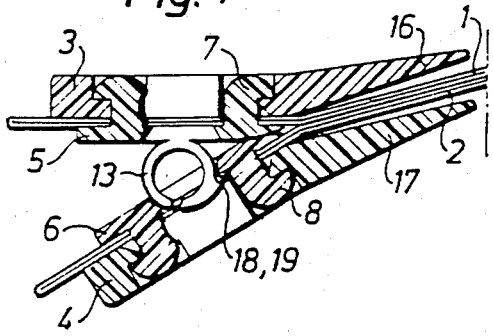
Figure 5:
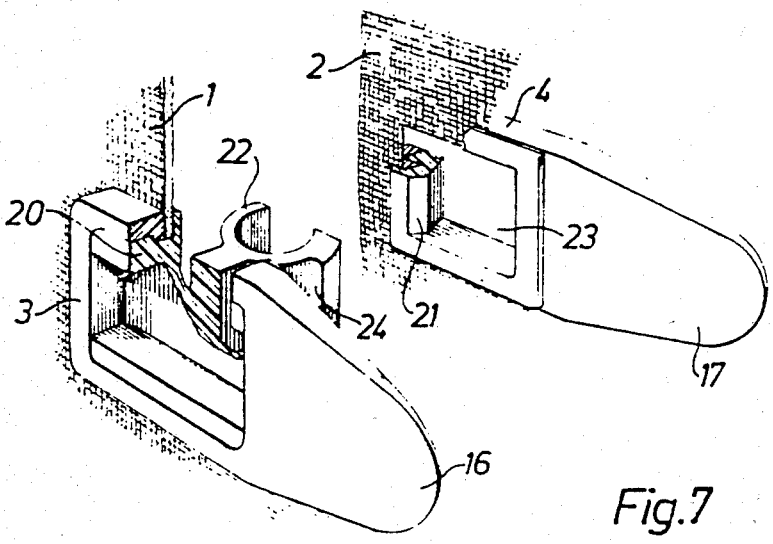
FIG. 5 illustrates an alternative embodiment of a fastener means intended for fastening two cloth pieces together.

As shown in FIG. 4, in order to disengage the fastener members the lever arms 16 and 17 are pressed towards one another, which can be done using one hand only relatively to one another along an abutment line lying between the locking plates 5 and 6. These locking plates are, to this end, provided with chamfered edge portions. As a result of the aforesaid pivoting movement, the outwardly projecting elements 13 and 14, during co-action between their shoulders 18 and corresponding shoulders 19 on respective locking plates, will be drawn out of engagement with an opposing locking plate, as illustrated in FIG. 4 with respect to projection 13. The pieces of cloth 1 and 2 can then be separated, for removal of a boom cover according to FIG. 2 for example.

FIGS. 5–8 illustrate an alternative embodiment, certain members of the fastener means being identified with the same references as those used in FIGS. 1–4. In the alternative embodiment the inner locking members 20 and 21 are of different design. For example, the locking element 20 is provided with a projection 22 intended to engage in an opening 23 in the opposing locking member 21, so as to lock the two fastener members together.

Figure 6:
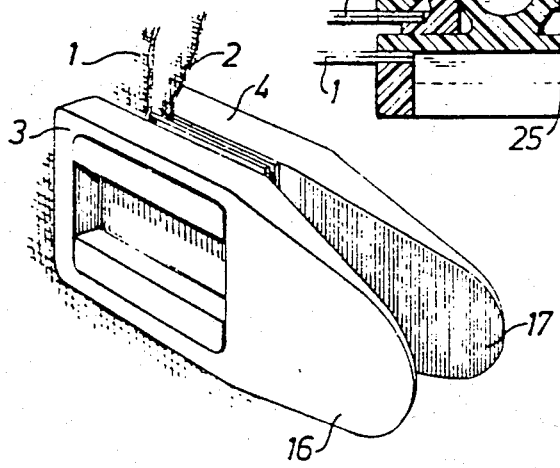
FIG. 6 illustrates the fastener means shown in FIG. 5 in a fastening position.
Figure 8:
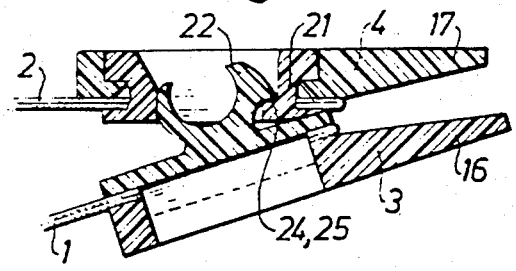

FIG. 6 illustrates the fastener members when they are brought into engagement with one another, to fasten the two cloth pieces 1 and 2 together.

Figure 7:
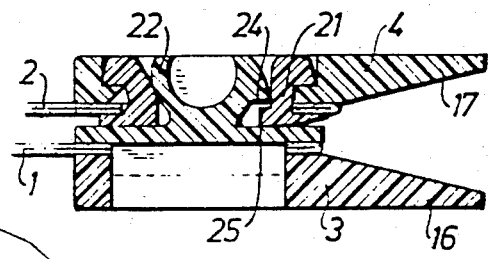
FIGS. 7 and 8 are sectional views of the fastener means illustrated in FIGS. 5 and 6, in locked and open positions respectively.

FIG. 7 is a sectional view of the fastener means illustrated in FIG. 6, and illustrates the projection 22 pressed into the opening 23 in the locking plate 21.

Engagement between the two fastener members is released in the same manner as that described with reference to the embodiment illustrated in FIGS. 1–4, namely by manually pressing the two lever arms 16 and 17 towards one another, whereupon the fastener members are swung relative to one another about a common contact line during the co-action between a shoulder portion 24 on the projection 22 and a corresponding shoulder portion 25 on the locking plate 21. In order to insure against unintentional release of the fastener means, inter alia as a result of pulling the cloth to which the fastener means is attached, the fastener means should be directed with their respective lever arms inwardly of the said cloth pieces, in a manner corresponding to that illustrated in FIGS. 1 and 2.

In addition to fastening together two pieces of cloth, in the above illustrated manner, a fastener means according to the invention can also be used to fasten a cloth to a fixed support. In this case, either one or the other of the fastener members illustrated, for example, in FIGS. 5–8 is attached to the cloth and the locking plate of the other fastener member is attached to the support to which the cloth is to be fastened. Disengagement between the fastener member attached to the cloth and the locking plate on the support is effected by pressing the lever arm of the cloth-attached fastener member towards the support. This release can readily be effected using one hand only, without needing to pull the cloth. The fastener members are also oriented in a manner to prevent unintentional release of the fastener members.

The aforedescribed fastener means, which may suitably be made from a thermoplastic material, for example acetal resin, may be modified in several respects, for example with respect to the design of the outer and inner members of respective fastener means, and also with respect to the design of the locking tongues and snap-in means. A common feature with all embodiments, however, is that they include lever arms to enable the snap-in engagement between two fastener members to be released.

I claim:

1. A fastener assembly for releasably securing a cloth article (1) and another article (2) together, comprising:

(a) a first fastener member including inner and outer elements (5,3; 20,3) adapted to be snapped together through an aperture (9) in the cloth article with the cloth article clamped between them, (b) a resiliently deformable projection (13; 22) extending outwardly from the inner element and defining a hook portion (18; 24) along one outer side thereof, (c) a second fastener member (4,6; 4,21) adapted to be mounted to another article, (d) an aperture (12; 23) defined in the second fastener member, said aperture being configured to retainably accommodate the projection on the inner element of the first fastener member and having an engagement portion (19; 25) along one inner side thereof adapted to lockingly coact with the hook portion of the projection, the projection being deformably insertable through the aperture by bringing the first and second fastener members together along a common abutment line proximate the hook and engagement portions and then pivoting them relative to each other in a first sense to effect a snap fit, and (e) a lever portion (16) extending laterally outwardly from the outer element as a substantially planar projection thereof and integral therewith, the snap fit being releasable by pressing the lever portion towards the second fastener member to pivot the first and second fastener members relative to each other in a second sense opposite the first sense.

2. A fastener assembly according to claim 1, wherein said another article is a cloth article, and the second fastener member also includes an integral lever portion (17) extending laterally outwardly therefrom as a substantially planar projection thereof, the lever portions of the first and second fastener members being disposed opposite each other such that they may be pressed together to release the snap fit.

3. A fastener assembly according to claim 2, wherein the first and second fastener members are identically constructed with the second fastener member also including inner and outer elements (6, 4) adapted to be snapped together through an aperture in the cloth article with said article clamped between them, the inner element of the second fastener member also having a resiliently deformable projection (14) extending outwardly therefrom and defining a hook portion along one outer side thereof, and the first fastener member also having an aperture (11) configured to retainably accommodate the projection of the second fastener member and having an engagement portion along one inner side adapted to lockingly coact with the hook portion of the second fastener member projection.

4. A fastener assembly according to claim 1, 2 or 3, wherein the or each projection is a slotted cylinder.

5. A fastener assembly according to claim 4, wherein the or each hook portion and engagement portion comprises a shoulder, and following a snap fit the shoulders on coacting hook and engagement portions interlock to maintain the snap fit.

6. A fastener assembly according to claim 5, wherein the or each inner element includes a locking tongue (7, 8) disposed to engage a projection of an opposite fastener member upon a snap fit to prevent the release of a fastener member from its clamped cloth article.

* * * * *